United States Patent [19]

Runnalls

[11] Patent Number: 4,977,764

[45] Date of Patent: Dec. 18, 1990

[54] LOCK BOX

[76] Inventor: Larry G. Runnalls, 25149 - 72 Avenue, Aldergrove, British Columbia, Canada, V0X 1A0

[21] Appl. No.: 449,760

[22] Filed: Dec. 13, 1989

[51] Int. Cl.[5] ..... E05B 65/52

[52] U.S. Cl. ..... 70/63; 70/168

[58] Field of Search ..... 70/173, 172, 171, 170, 70/169, 168, 167, 166, 165, 164, 163, 63; 109/51

[56] References Cited

U.S. PATENT DOCUMENTS

| | | | |
|---|---|---|---|
| 1,026,649 | 5/1912 | Beshore | 70/168 |
| 1,267,204 | 5/1918 | Shanahan | 70/169 |
| 1,928,879 | 10/1933 | Causey | 70/173 |
| 2,002,260 | 5/1935 | Curl | 70/168 |
| 2,677,338 | 5/1954 | Sassetti | 70/169 |

*Primary Examiner*—Robert L. Wolfe

*Attorney, Agent, or Firm*—John Russell Uren

[57] ABSTRACT

A lock box having a housing and a lid mounted to said housing. The housing has a ridge mounted about its inner periphery adjacent its open side. A retainer on the lid which is complementary to the ridge is mounted over the ridge to retain the lid in its mounted position. A spring biased pin is mounted to the lid and extends between a retracted position where the lid can be removed from the housing and an extended position where the lid is locked to the housing. A lock controls the position of the pin as it moves between the retracted and extended positions.

7 Claims, 2 Drawing Sheets

LOCK BOX

INTRODUCTION

This invention relates to a lock box and, more particularly, to a lock box which has a lid removably connected to the housing.

BACKGROUND OF THE INVENTION

The use of lock boxes for security purposes to hold keys or cards in the event of card access is pervasive. House sellers use such lock boxes to hold keys for opening the houses for potential customers to whom they offer the houses for purchase. Security guards use lock boxes as they make their rounds of areas to be checked against break ins. Other lock boxes are used to allow access to certain secure areas of property or equipment by individuals such as fire and policemen and are used for emergency or service purposes.

Current lock boxes, however, suffer disadvantages. A fundamental difficulty is that such lock boxes can be broken into without substantial difficulty. One reason this is so is because the drive cam of a standard cylinder lock is used itself for locking and provides poor integrity between the body and the cover since it may easily be pried off. A screwdriver or other sharp edged tool can be inserted between the lid of the lock box and the housing to pry the cover off the housing so that the box can be entered. A further difficulty for security is that lock boxes are attached to a support using light duty attachments that can easily be defeated to remove the lock box.

SUMMARY OF THE INVENTION

According to one aspect of the present invention, there is disclosed a lock box comprising a housing having an open side, a lid removably mounted to said housing on said open side, a ridge on said housing extending around the inner periphery of said housing adjacent said open side, a retainer on said lid complementary to said ridge, said retainer being operable to extend beneath said ridge and a first pin movable between an extended position beneath said ridge when said lid is mounted to said housing and a retracted position to allow removal of said lid from said housing.

BRIEF DESCRIPTION OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
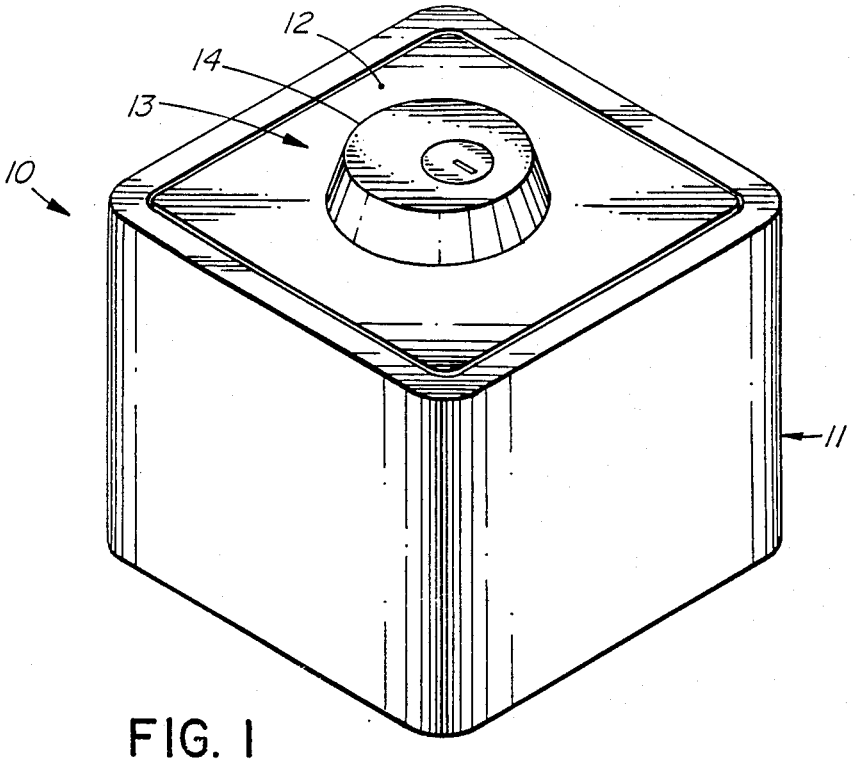
FIG. 1 is an isometric view of the lock box according to the invention with its lid installed.

Referring now to the drawings, a lock box made of ¼ inch structural steel is shown generally at 10 in FIG. 1.

It comprises a housing shown generally at 11 and a lid shown generally at 12. The lid 12 includes a lock generally illustrated at 13. The lock 13 further includes a collar 14 made from hardened steel and fits around the key operated cylinder of the lock 13.

Figure 2:
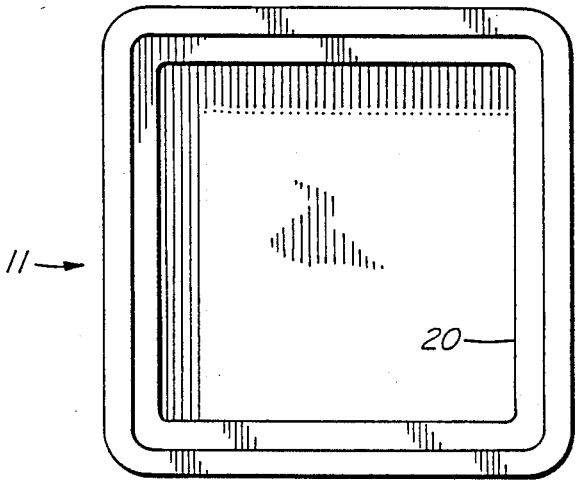
FIG. 2 is a plan view of the lock box of FIG. 1 with its lid removed.
Figure 4:
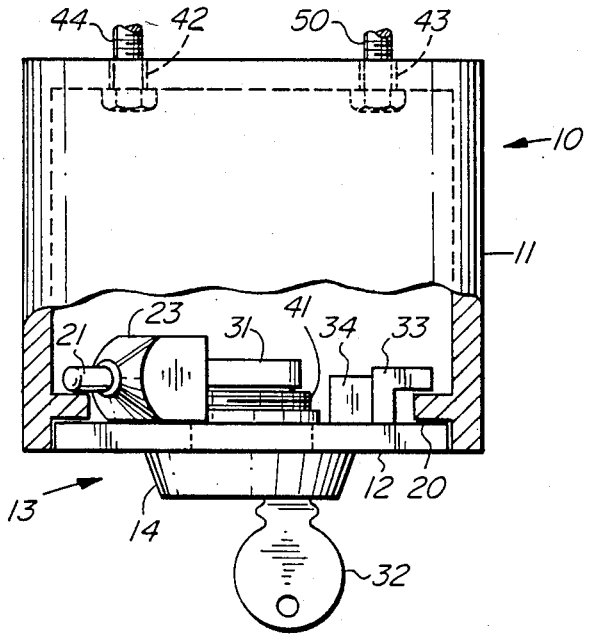
FIG. 4 is a cutaway and sectional view of the lock box according to the invention illustrating the lid in its closed position on the housing of the lock box.

The housing 11 is shown with the lid removed in FIG. 2. The housing 11 has a square opening of approximately 3½ inches in width on one side. A ridge 20 is mounted about the inner periphery of the housing 11 of the lock box 10 adjacent the opening as is also seen in FIG. 4.

Figure 3:
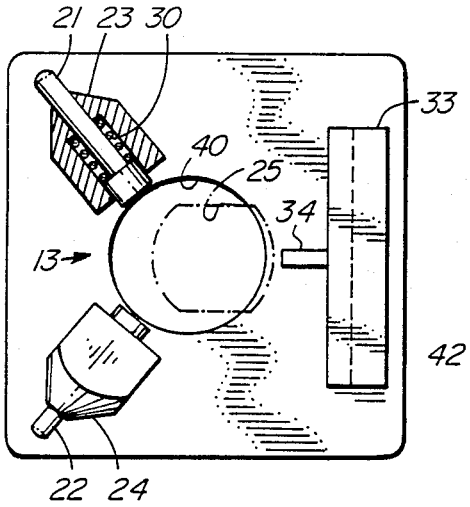
FIG. 3 is a diagrammatic inside view of the lid of the lock box according to the invention particularly illustrating the locking pins, the lock and the retainer.

The lid or cover 12 is shown removed in FIG. 3. It comprises a pair of pins 21, 22 mounted within respective pin guides 23, 24 which are movable between retracted positions as illustrated under the influence of springs 30 (only one of which is shown) and extended positions under the influence of a cam 31 (FIG. 4) which rotates under the influence of a key 32 which fits the cylinder of the lock 13. The cam 31 is not shown in FIG. 3. Thereafter, the cylinder of the lock 13 is manually rotated to rotate the cam 31. The cam 31 moves the pins 21, 22 to their extended positions. The cover 12 can have either of two openings 40, 25, depending on whether the key operated lock 13 is of the cylindrical or cam type configuration. If cylindrical, the hole 40 will be 1⅛ inch in diameter. If of the cam type, the hole 25 will be ⅞ square "d".

A retainer 33 is welded onto the lid 12. The retainer 33 is in the form of an inverted "L" as best seen in FIG. 4 and is complimentary to the ridge 20 of the housing 11. A support bracket 34 is welded between the lid 12 and the retainer 33 to increase the strength of the retainer 33 and further act as a stop for the cam 31 (FIG. 4).

A cylinder lock 13 is mounted in the circular hole 40 cut in the lid 12. The cam 31 is connected to the cylinder 41 of the lock 13 and is rotated under the influence of key 32 (FIG. 4). The cam 31, upon rotation, contacts the pins 21, 22 and moves them to their extended positions.

Figure 5:
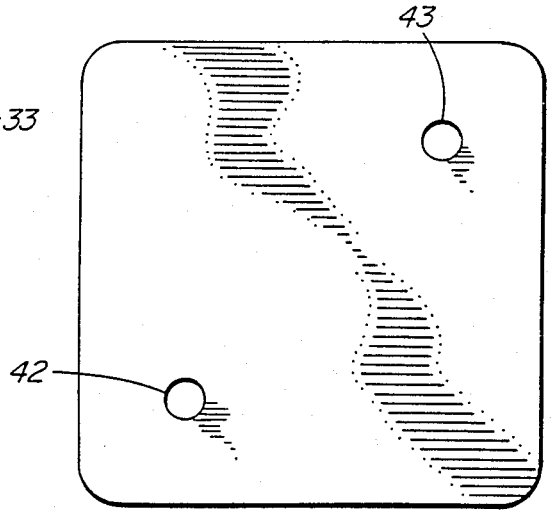
FIG. 5 is a view of the housing of the lock box illustrating the mounting holes for mounting the lock box to a support structure.

The housing 11 is shown in more detail in FIG. 4. Two holes 42, 43 (FIG. 5) are drilled into the housing 11. They act to allow bolts 44, 50 to extend from the inside of the housing 11 through the holes 42, 43 and into a support structure such as a wall (not illustrated).

OPERATION

In operation, bolts 44, 50 are inserted from the inside of the lock box 10 and extend into the support structure through the holes 42, 43.

A key (not shown), card or similar device is then positioned in the lock box 10 and the lid 12 is mounted to the housing 11 by first fitting the retainer 33 on the lid 12 over the ridge 20 of the housing 11 and abutting the ridge 20 on the housing 11 with the lid 12 around the periphery of the ridge 20.

The key 32 is then inserted into the lock 13 and is rotated. The cam 31 on the end of the cylinder 41 of the lock 13 rotates under the influence of the key 32 and contacts the ends of the pins 21, 22. Continued rotation then extends the pins 21, 22 against the biasing action of the springs 30 within the pin guides 23, 24 holding the pins 21, 22. The pins 21, 22 are extended until they fit under the ridge 20 of the housing 11. The key 32 is then removed from the lock 13 and the lock box 10 is securely closed with the pins 21, 22 remaining in their extended positions beneath the ridge 20 of the housing 11.

Several items of interest are noted. Initially, it is noted the opening of the lock box 10 is square which allows the lid !2 to be mounted in any position. The lock 13 has considerable integrity since the cam 31 is not used to hold the cover 12 in its closed position. Finally, the strength of the lock box 10 is such that it is very difficult to enter the lock box 10 without authorization in order to obtain the key or card contained within the lock box 10.

Many modifications will readily occur to those skilled in the art to which the invention relates. For example, the cam 31 could be of a different configuration and the opening of the housing 11 could be rectangular instead of square. The size of the lock box 10 could be various to fulfil different purposes.

Many other modifications than those set out will readily occur to those skilled in the art to which the invention relates and the specific embodiments set forth herein should be considered as illustrative of the invention only and not as limiting its scope as defined in accordance with the accompanying claims.

What is claimed is:

1. A substantially rectangular lock box comprising a housing having an open side, a substantially rectangular lid removably mounted on said housing on said open side, a ridge on said housing extending around the inner periphery of said housing adjacent said open side, a retainer on one side of said lid complementary to said ridge, said retainer being operable to extend beneath said ridge and a pair of pins on an opposite side of the lid and each extending towards a corner of the lid on said opposite side of the lid, wherein each pin is movable between an extended position beneath said ridge when said lid is mounted on said housing and a retracted position to allow removal of said lid from said housing.

2. A lock box as in claim 1 wherein said pins are biased to said retracted position.

3. A lock box as in claim 2 and further comprising a lock to move said pins between said extended and retracted positions.

4. A lock box as in claim 3 and further comprising means for mounting said housing to a support.

5. A lock box as in claim 4 wherein said ridge on said housing extends around only a portion of said inner periphery.

6. A lock box as in claim 1 wherein each pin extends diagonally towards a corner of the lid.

7. A lock box as in claim 1 wherein the box and the lid are square.

* * * * *